US007588080B2

(12) United States Patent
McCoy

(10) Patent No.: US 7,588,080 B2
(45) Date of Patent: Sep. 15, 2009

(54) METHOD FOR INSTALLING WELL COMPLETION EQUIPMENT WHILE MONITORING ELECTRICAL INTEGRITY

(75) Inventor: Robert H. McCoy, Talala, OK (US)

(73) Assignee: Baker Hughes Incorporated, Houston, TX (US)

( * ) Notice: Subject to any disclaimer, the term of this patent is extended or adjusted under 35 U.S.C. 154(b) by 200 days.

(21) Appl. No.: 11/358,191

(22) Filed: Feb. 20, 2006

(65) Prior Publication Data

US 2006/0213659 A1 Sep. 28, 2006

Related U.S. Application Data

(60) Provisional application No. 60/664,485, filed on Mar. 23, 2005.

(51) Int. Cl.
*E21B 47/00* (2006.01)

(52) U.S. Cl. ..... 166/250.01; 166/65.1

(58) Field of Classification Search ..... 166/65.1, 166/66, 385, 68, 77.1, 105; 242/376, 407; 191/12.2 R, 12.2 A
See application file for complete search history.

(56) References Cited

U.S. PATENT DOCUMENTS

| | | | | |
|---|---|---|---|---|
| 2,061,863 | A | 11/1936 | Wells | |
| 3,040,308 | A * | 6/1962 | Hubby | 166/66 |
| 3,588,689 | A | 6/1971 | Crawford | |
| 4,534,424 | A | 8/1985 | Ramsey | |
| 4,568,933 | A * | 2/1986 | McCracken et al. | 340/855.3 |
| 4,636,934 | A * | 1/1987 | Schwendemann et al. | 700/3 |
| 4,770,034 | A * | 9/1988 | Titchener et al. | 340/854.3 |
| 4,790,378 | A * | 12/1988 | Montgomery et al. | 166/66 |
| 4,846,269 | A * | 7/1989 | Schnatzmeyer | 166/65.1 |
| 5,180,014 | A * | 1/1993 | Cox | 166/384 |
| 6,192,983 | B1 * | 2/2001 | Neuroth et al. | 166/250.15 |
| 6,585,041 | B2 * | 7/2003 | Crossley | 166/53 |
| 6,938,689 | B2 * | 9/2005 | Farrant et al. | 166/66 |
| 6,945,330 | B2 * | 9/2005 | Wilson et al. | 166/373 |
| 2003/0141055 | A1 * | 7/2003 | Paluch et al. | 166/254.2 |
| 2004/0020644 | A1 * | 2/2004 | Wilson et al. | 166/250.01 |
| 2005/0034857 | A1 * | 2/2005 | Defretin et al. | 166/250.01 |
| 2006/0102341 | A1 * | 5/2006 | Freer et al. | 166/250.01 |

OTHER PUBLICATIONS

Fusiek G, Niewczas P, McDonald Jr, "Extended step-out length fiber Bragg grating interrogation system for condition monitoring of electrical submersible pumps", published Mar. 18, 2005, Optical Engineering 44 (3) 034404.*

Mave, ML, "Considerations for application of electrical submersible pumps for underground coal mine dewatering", Sep./Oct. 1989, IEEE Transactions on Industry applications, vol. 25 No. 5, pp. 846-850.*

* cited by examiner

*Primary Examiner*—Jennifer H Gray
*Assistant Examiner*—Cathleen R Hutchins
(74) *Attorney, Agent, or Firm*—Bracewell & Giuliani LLP

(57) ABSTRACT

A method of installing a submersible electrical pump assembly in a well monitors the integrity of the pump assembly and electrical cable while the pump assembly is being run. The pump assembly has at least one sensor that measures a parameter in the environment of the pump assembly. A battery-powered test unit is mounted to the reel of cable, and a lead of the unit is connected to the power cable. While lowering the completion equipment, test voltage is supplied from the unit via the power cable through the motor to the sensor. The unit transmits an indication to a remote monitor that the sensor is operational.

17 Claims, 5 Drawing Sheets

METHOD FOR INSTALLING WELL COMPLETION EQUIPMENT WHILE MONITORING ELECTRICAL INTEGRITY

CROSS REFERENCE TO RELATED APPLICATION

This application claims priority to provisional application Ser. No. 60/664,485, filed Mar. 23, 2005.

FIELD OF THE INVENTION

This invention relates in general to running into a well downhole completion equipment having electrical components, and in particular to a method for installing a submersible pump assembly while monitoring the integrity of the electrical components of the assembly.

BACKGROUND OF THE INVENTION

Electrical submersible pumps (ESP) are commonly used in oil wells for pumping oil and formation water to the surface. An ESP comprises a pump having a downhole electrical motor. The pump typically is a centrifugal pump having a large number of stages, each stage having an impeller and a diffuser. Alternately, the pump could be another type, such as a progressing cavity pump. The ESP may also have one or more sensors for sensing well parameters such as pressure and temperature.

Normally the ESP is lowered into the well on production tubing which comprises joints approximately 30 feet in length secured together by threads. Alternately, the tubing could comprise continuous coiled tubing. A power cable is connected to the motor of the pump while it is at the surface and deployed from a reel while lowering into the well.

The ESP and power cable are subject to being damaged during running. Damage can result due to striking objects in the well, vibration, shock or from the well temperature. If the problem is discovered only after the ESP is completely installed, expense and time are incurred to pull the ESP, tubing and power cable from the well. The well could be thousands of feet deep. Consequently, it is not uncommon for the operator to stop the rig and connect the ends of the power cable to equipment on the surface to check the integrity of the system. Stopping the rig to perform these test adds to the running time for the ESP.

Downhole completion equipment other than ESPs also encounter the same problem. For example, sliding sleeve subs, packers, gravel packing tools, sand control screens and the like may include electrical actuators and/or sensors such as position indicating devices. These types of completion equipment are also run on tubing and may have an electrical line deployed from a reel.

SUMMARY OF THE INVENTION

In the method of this invention, the completion equipment is lowered into the well in a non operational state while deploying the electrical line. Without causing the completion equipment to enter an operational state, test power is supplied to the electrical line periodically and a response is displayed at the surface to monitor the integrity of the completion equipment and the electrical line. When at a desired depth, the completion equipment is secured in the well and placed in an operational state.

The electrical line is preferably wound on a reel and deployed from the reel while the completion equipment is lowered into the well. A battery-powered test unit is mounted to the reel and releasably connected to the electrical line. The test power to the electrical line is supplied by the unit, which also receives the response. Preferably, the response is transmitted from the unit to a remote monitor by radio frequency.

In one example, the completion equipment comprises an electrical submersible pump assembly, and the test power is supplied over the power cable leading to the motor of the pump assembly. Preferably, the pump assembly includes a pressure sensor, and the test power is sent to the pressure sensor.

In another example, the test power is used to measuring a resistance to ground of the electrical line. In a further example, the completion equipment comprises a submersible pump assembly, and the test power is used to measure an impedance of the motor of the pump assembly.

DETAILED DESCRIPTION OF THE INVENTION

Figure 1:
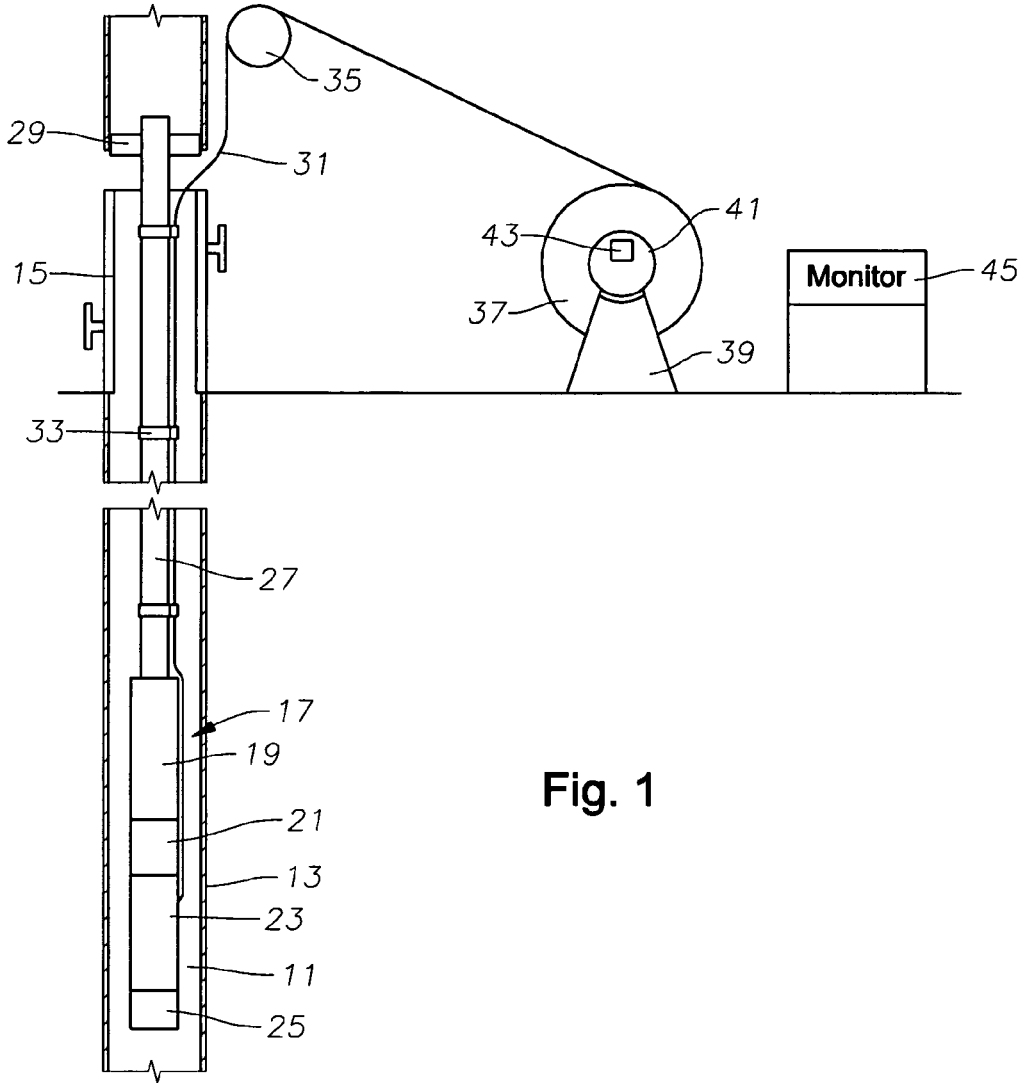
FIG. 1 is a schematic view illustrating an ESP being lowered into a well while monitoring the integrity of the electrical cable and ESP in accordance with this invention.

Referring to FIG. 1, a well 11 has one or more strings of casing 13 installed within the well. A production tree 15 is located at the upper end of well 11 for controlling the flow of the well fluids from well 11.

An electrical submersible pump assembly 17 ("ESP") is shown being lowered into well 11. ESP 17 includes a centrifugal pump 19 having a large number of stages of impellers and diffusers. A seal section 21 connects the lower end of pump 19 to a motor 23. In some instances, a sensor unit 25 is secured to the lower end of motor 23 for providing signals corresponding to pressure and temperature. ESP 17 could alternately employ a progressing cavity type pump, which utilizes a stationary stator having a helical cavity. A rotor with helical lobes rotates within the stator, the rotor being driven by an electrical motor.

In this example, a string of production tubing 27 is employed to lower ESP 17 into the well. Production tubing 17 is normally made up of individual sections of pipe, each about thirty feet in length, the joints of pipe being secured together by threaded ends. A lifting device, comprising a set of elevators 29 engages the upper end of tubing 27, the elevators 29 being supported by a derrick with draw works (not shown). Alternately, tubing 27 could be continuous or coiled tubing deployed from a coiled tubing unit, rather than rig elevators 29.

A power cable 31 connects to motor 23 via a motor lead, which is not shown separately and is considered herein to be a part of power cable 31. Power cable 31, in this example, extends alongside tubing 27 and is secured at intervals by clamps 33. Power cable 31 extends over a sheave 35 suspended from the derrick (not shown) to a reel 37. Power cable 31 is wrapped around and stored on reel 37, which is brought to the site of well 11 when ESP 17 is to be deployed. Reel 37 has a stand 39 for supporting reel 37 on the ground or on a vehicle. Reel 37 also has a hub 41 that rotates with reel 37.

A test unit 43 is connected to the upper end of power cable 31 for measuring the integrity of power cable 31 as ESP 17 is lowered into the well. In this embodiment, test unit 43 rotates with reel 37 and sends a wireless signal to a monitor 45 located nearby. Monitor 25 displays a reading to operating personnel of the integrity of cable 31 and motor 23. Test unit 43 may operate continuously or it may perform the test at selected intervals.

Figure 2:
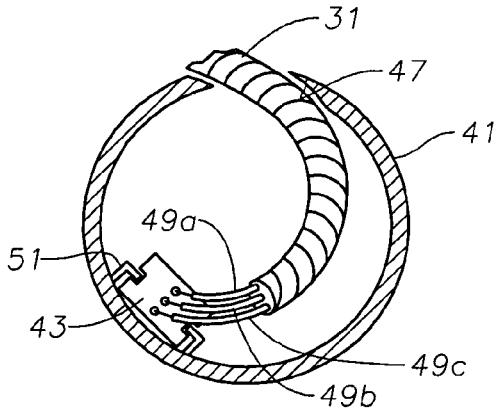
FIG. 2 is a schematic view illustrating a portion of the cable reel shown in FIG. 1 and a test unit mounted thereto.

Referring to FIG. 2, in one embodiment, hub 41 is hollow and has an opening 47 therein for receiving the upper end of cable 31. Power cable 31 has three insulated electrical conductors 49A, 49B and 49C. Each conductor 49A, B and C is releasably connected by a conventional connection to test unit 43. Test unit 43 is releasably mounted to the inner surface of hub 41 for rotation therewith. In this embodiment, a pair of resilient clips 51 engage test unit 43 to retain it with hub 41. Alternately, test unit 43 could be mounted to the flanges or spokes of reel 37. Other means of attachment are also feasible, such as a magnetic base on the housing of test unit 43.

Figure 3:
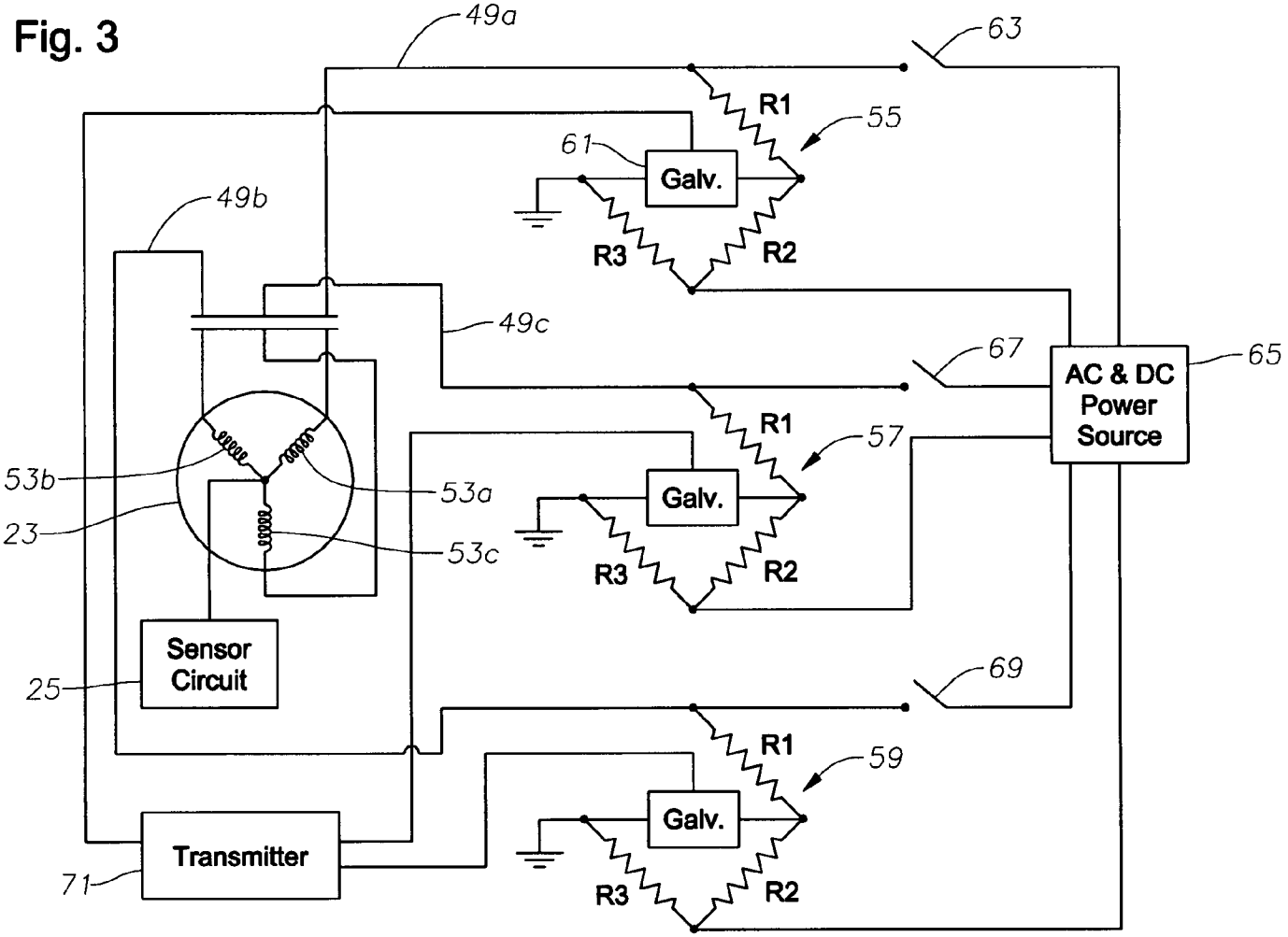
FIG. 3 is a simplified electrical schematic illustrating monitoring resistance and impedance of the power cable conductors in accordance with this invention.

Referring to FIG. 3, motor 23 is normally a three-phase motor having windings 53A, 53B and 53C. Windings 53A, B and C may be connected in a Y connection as shown in FIG. 3 or in a Delta configuration (not shown). For a Y connection, sensor circuit 25, if employed, is preferably connected to the node between the three windings 53A, B and C. The connection of windings 53A, B and C is at the lower end of motor 23 (FIG. 1).

One task of test unit 43 is to measure the electrical resistance of each cable conductor 49A, 49B and 49C to each other and to ground. That resistance should be infinite, and if not, it is likely that damage to the electrical insulation of one or more of the conductors 49A, B and C has occurred. Various circuitry may be employed to monitor that resistance. In this example, a separate Wheatstone bridge circuit 55, 57 and 59 is employed to monitor the resistance of each conductor 49A, 49C and 49B, respectively. Alternately, a single bridge circuit could be employed, with a sequencing device switching between each conductor 49A, 49B and 49C. Each bridge circuit 55, 57 and 59 has four legs, each containing a resistor R1, R2 and R3. Resistors R1, R2, and R3 are of known value. One node for the fourth leg is connected to ground, while the other node for the fourth leg is connected to one of the conductors 49A, 49B or 49C. A galvanometer or other current measuring device 61 is connected to the node between R1 and R2 and to ground. A power source 65 is connected to the node between R2 and R3 and to one of the conductors 49A, 49B or 49C. If desired, a switch 63, 67 and 69 may be utilized to electrically turn on and off voltage from power source 65.

Power source 65 is preferably a battery with an inverter so that it will supply DC voltage as well as AC voltage. The DC voltage causes Wheatstone bridges 55, 57 and 59 to provide a current measurement that correlates with a resistance value for each of the conductors 49A, 49B, 49C. Current measuring device 61 is connected to a transmitter 70, which sends the value of the resistance to monitor 45. When AC power is supplied, the AC current measured by current measuring device 61 correlates with an impedance value for each of the conductors 49A, 49B and 49C.

Figure 4:
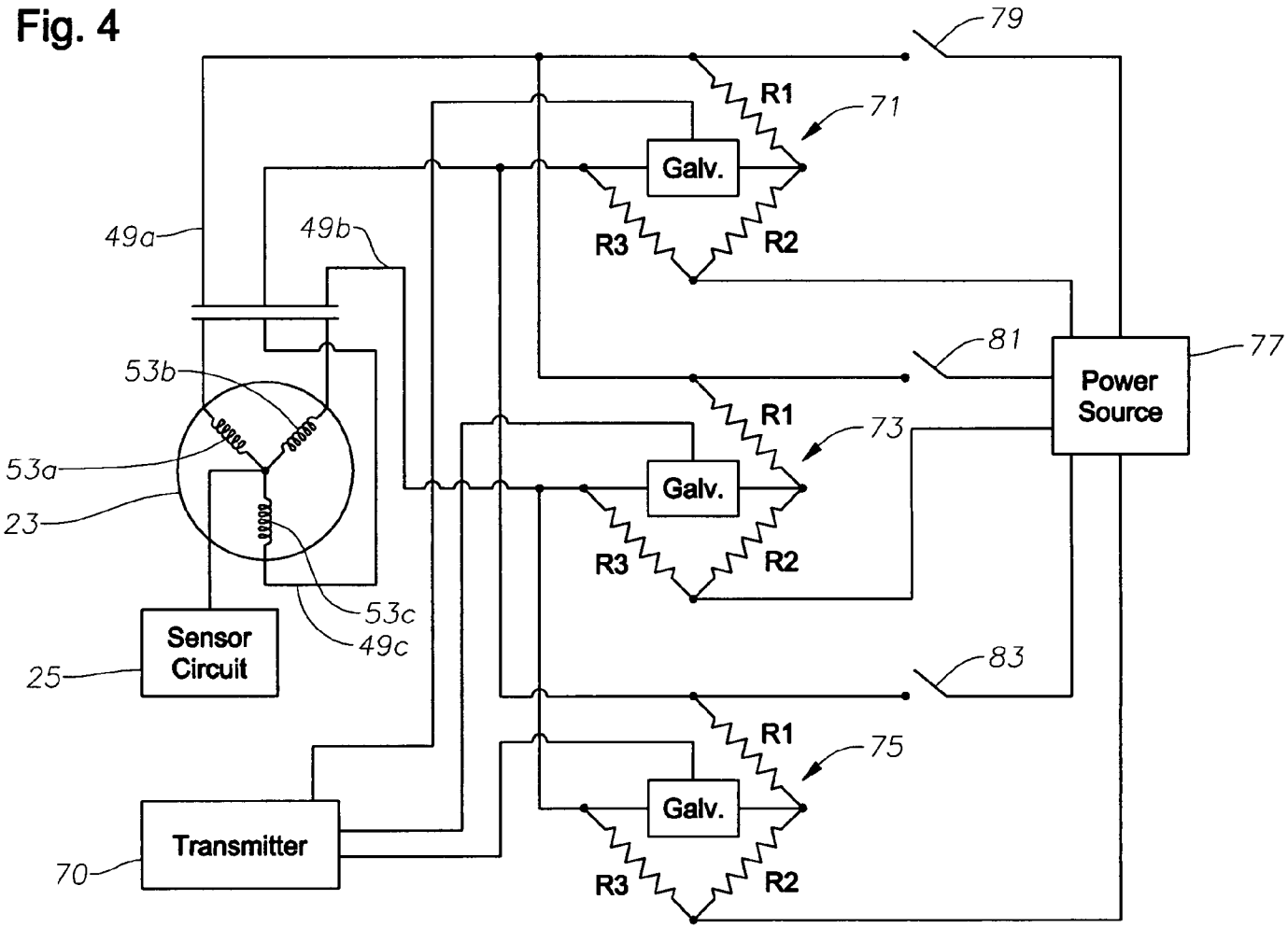
FIG. 4 is a simplified electrical schematic illustrating monitoring the impedance of the electrical motor in accordance with this invention.

Referring to FIG. 4, preferably the impedance of electrical motor 23 is also monitored while deploying ESP 17. In FIG. 4, this is handled by three Wheatstone bridge circuits 71, 73 and 75. Each bridge circuit 71, 73 and 75 is configured as in FIG. 3, having resistors R1, R2 and R3 connected in the same manner. Conductors 49A and 49C are connected to the fourth leg nodes of bridge circuit 71. Conductors 49A and 49B are connected to the fourth leg nodes of bridge circuit 73. Conductors 49B and 49C are connected to the nodes of the fourth leg bridge circuit 75.

Current measuring device 61 provides to transmitter 70 readings that correspond to the motor 23 impedance. Each bridge circuit 71, 73 and 75 is connected to power source 65 for supplying AC voltage. Switches 79, 81 and 83 may be employed to block the power source 65 from any one of the bridge circuits 71, 73 and 75. Furthermore, the separate bridge circuits 71, 73 and 75 could be consolidated along with bridge circuits 55, 57 and 59 into a single bridge circuit for sequential operation.

During the installation operation, the operator will assemble ESP 17 and connect power cable 31 to the motor lead of motor 23. The operator will connect the upper end of power cable 31 to test unit 43, as illustrated in FIG. 2. The operator lowers ESP 17 on tubing 27 while unwinding power cable 31 from reel 37. From time to time the operator will strap power cable 31 to tubing 27 with clamps 33. No operational power is supplied to motor 23 while ESP assembly 17 is being lowered into the well, thus pump 19 remains non operational.

At all times, the operator will be able to monitor the resistance and impedance of power cable 31. Test unit 43 (FIG. 1) provides AC and DC current measurements to ground of each conductor 49A, 49B and 49C, as illustrated in FIG. 3. These values provide resistance and impedance readings, and transmitter 70 sends signals to monitor 45 to display the measurements to the operator. At the same time, test unit 43 applies AC voltage between conductors 49A, 49B and 49C, as shown in FIG. 4, to determine the impedance through motor 23. The various measurements could be made sequentially. Rather than continuous operation, the test voltage from test unit 43 could be supplied automatically or manually at selected time intervals. If a reading appears that is outside of a selected range, the operator could pull ESP 17 from the well before reaching its final depth.

If desired, and depending upon the type of sensor circuit 25, signals could also be sent to circuitry (not shown) within test unit 43 from sensor circuit 25 over conductors 49A, 49B and 49C. These signals could be converted into pressure and temperature readings and transmitted by transmitter 70 to monitor 45 (FIG. 1).

Figure 5:
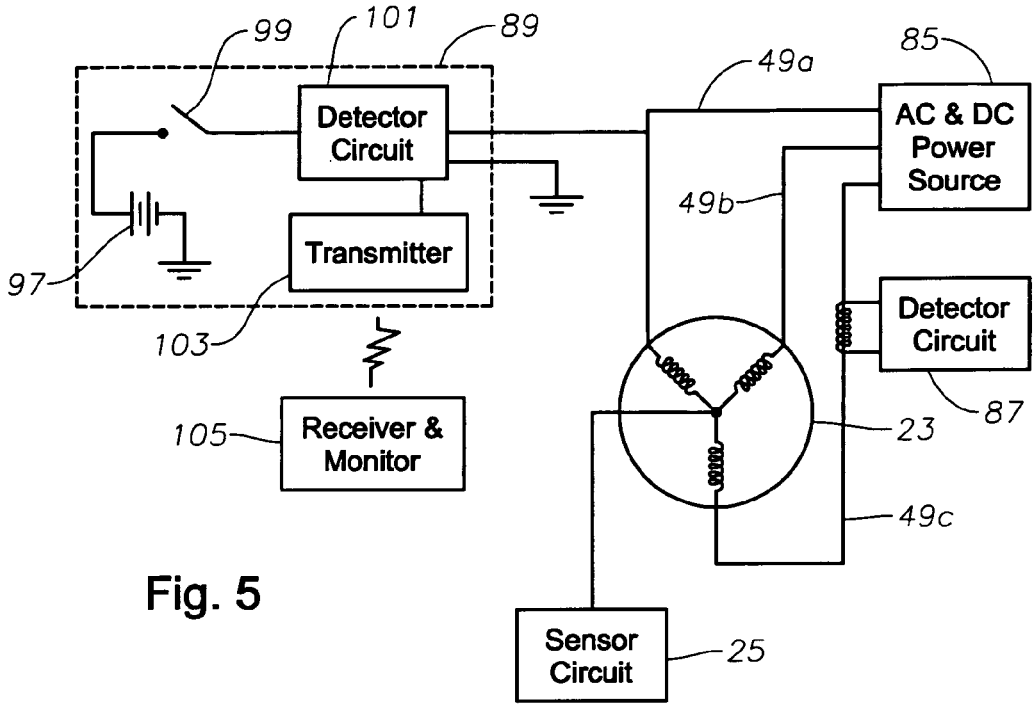
FIG. 5 is an electrical schematic of an alternate method for monitoring the integrity of an ESP and power cable.
Figure 6:
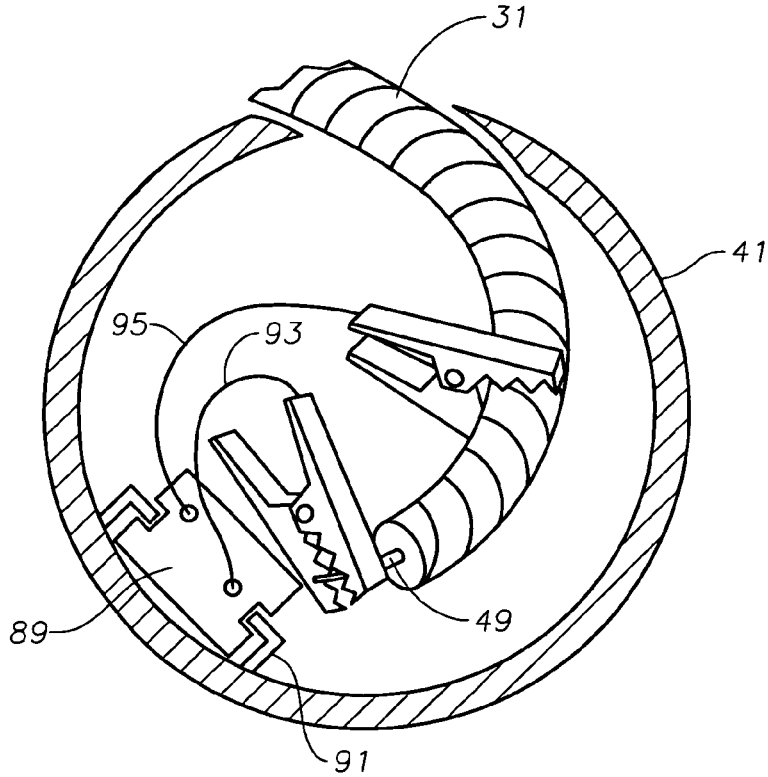
FIG. 6 is an enlarged schematic illustrating a portion of the cable reel in FIG. 5 and a test unit mounted thereto.

In the embodiment of FIGS. 5 and 6, the test unit does not check electrical resistance and impedance, rather it applies test voltage to the downhole sensor circuit 25. Sensor circuit 25 is conventional and may measure a variety of parameters during operation of motor 23 including well fluid pressure, motor lubricant temperature and vibration. Sensor circuit 25 may be a variety of types, either analog or digital. After installation, a conventional operational power source 85 supplies three-phase AC power over conductors 49A, 49B and 49C to motor 23. Sensor circuit 25 preferably receives its power from power source 85 over conductors 49, and the response of sensor circuit 25 is superimposed on conductors 49. During normal operation, sensor circuit 25 communicates with an operational detector circuit 87 that receives signals typically via power conductors 49. Operational detector circuit 87 and the method of telemetry with sensor circuit 25 may be conventional.

As shown in FIG. 6, test unit 89 is mounted by releasable retainer 91 to reel hub 41. Test unit 89 has a voltage lead 93 that has an alligator clip on its end for securing to one of the conductors 49. Test unit 89 has a ground lead 95 with an alligator clip that the operator clips preferably to the armor on power cable 31.

Referring again to FIG. 5, test unit 89 has a battery 97 and a switch 99 for applying voltage through a test detector circuit 101 to one of the conductors 49. Test detector circuit 101 may be constructed generally in the same manner as operational detector circuit 87. When energized, test detector circuit 101 will receive a signal indicating one or more of the parameters being monitored by sensor circuit 25. Preferably, test detector circuit 101 has a wireless transmitter 103 that transmits the response to a receiver and display or monitor 105 located nearby.

In the operation of the embodiment of FIGS. 5 and 6, as the pump assembly is lowered into the well, power from operational power supply 85 will remain off. Test detector circuit 101 applies voltage to one of the conductors 49 either continuously or periodically and receives a response from sensor circuit 25. If a signal is not received from sensor circuit 25, a component of the system, such as one in pump motor 23, sensor circuit 25 or power cable 31, is not functioning properly. The operator would then retrieve the pump assembly to diagnose the fault. While lowering the ESP assembly into the well, it is not necessary that test unit 89 provide accurate readings of the well environment parameters, rather it need only receive an indication that sensor circuit 25 is operational.

If the response indicates that the downhole system is functioning properly, the operator will set the pump assembly at the desired point, detach test unit 89 from reel hub 41, and connect power cable 31 to power source 85. Power source 85 supplies electrical power to place motor 23 in an operational state, causing the pump of ESP assembly 17 (FIG. 1) to operate. Sensor 25 will be powered by power source 85 and send signals to operational detector circuit 87.

Figure 7:
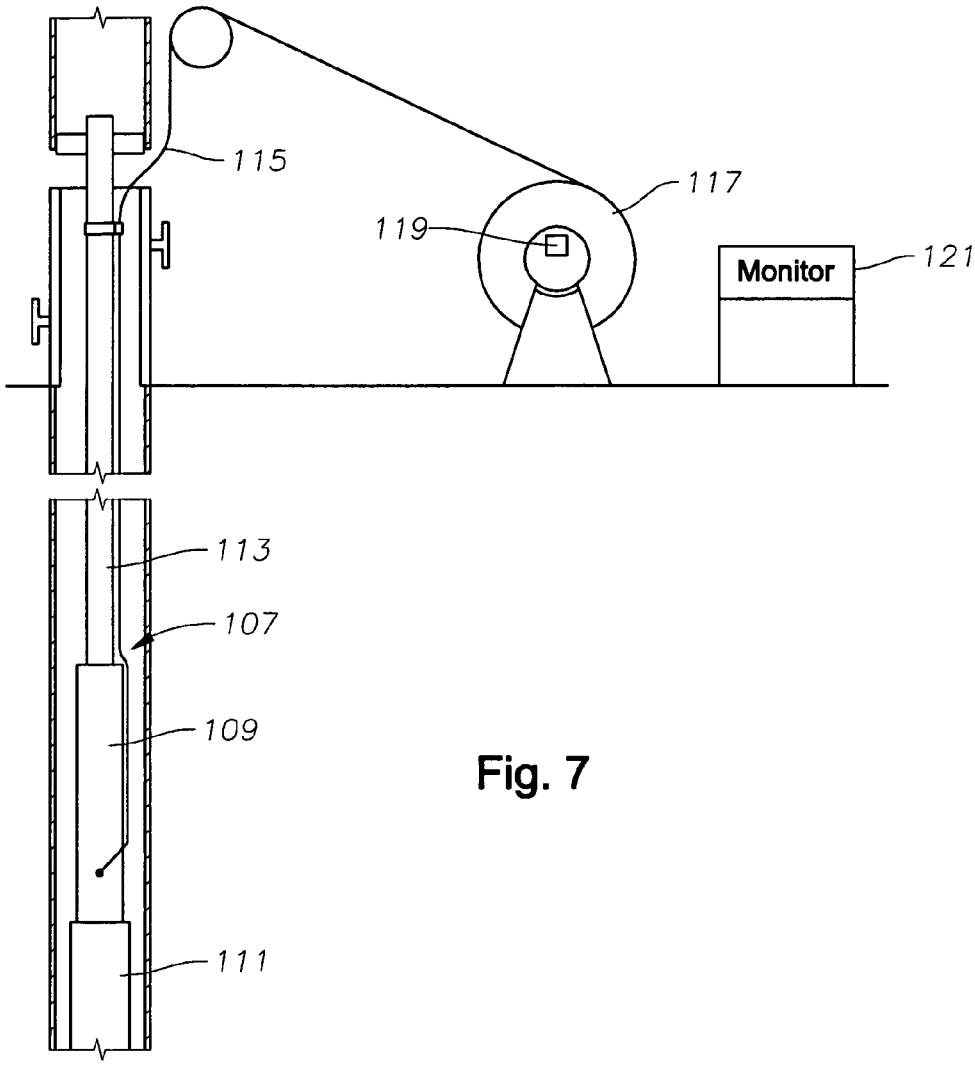
FIG. 7 is a schematic view of a packer being installed in a well in accordance with this method.

FIG. 7 schematically illustrates that the invention is applicable to downhole completion tools other than ESPs. Well completion assembly 107 could be a variety of devices, such as a gravel packing tool, a packer or bridge plug assembly or a sliding sleeve tool. In the example, a packer running tool 109 is attached to a packer 111 for setting packer 111 in the well. Running tool 109 is shown being lowered on a running string of conduit 113. An electrical line 115 leads from running tool 109 alongside running string 113. Electrical line 115 leads to an electrical component within running tool 109, such as a position sensor. Line 115 is deployed from a reel 117 while running string 113 is being lowered into the well. A test unit 119 similar to test unit 43 (FIG. 2) and test unit 89 (FIG. 6) is releasably mounted to the hub of reel 117 in the same manner as in the other embodiments. Periodically or continuously, test unit 119 provides voltage via line 115 to the sensor in running tool 109 and transmits a wireless signal to a monitor 121. Monitor 121 will display whether line 115 has maintained conductivity and the sensor is operational.

When at the desired setting depth, the operator might disconnect test monitor 119 and complete the setting operation conventionally. Alternately, test monitor 119 could continue to be used to provide voltage to electrical line 115 and signals to monitor 121 to indicate the positions of running tool 109 during the setting operation. After setting packer 111 to place it in an operational state, running tool 109 may be detached from packer 111 and retrieved along with electrical line 115.

Downhole completion assembly 107 could be of a type that when operational, remains connected to the running string 113, which in that instance, would likely comprise production tubing. For example, rather than packer 111 and running tool 109, the downhole completion tool could comprise a sliding sleeve for opening and closing access to the interior of the tubing string. Electrical line 115 could either be connected to a sensor that determines whether the sleeve is open or closed, or it could be connected to an electrical actuator, such as a motor or solenoid. If so, after installation, electrical line 115 would remain in the well alongside the tubing and connected to an operational power source at the surface. The test unit would apply voltage to the sliding sleeve component during the running process, then removed along with the reel.

The invention has significant advantages. The test unit allows an operator to check the electrical integrity of a downhole completion assembly while it is being run and without slowing down the running process. The method reduces the chances of having to retrieve a downhole completion assembly immediately after it has been installed. The test unit is readily attached to and removed from the electrical line being deployed. Because of the wireless transmitter, the test unit works with conventional reels and needs no slip rings to communicate signals.

While the invention has been shown in only three of its forms, it should be apparent to those skilled in the art that it is not so limited but is susceptible to various changes without departing from the scope of the invention.

I claim:

1. A method of installing downhole completion equipment in a well, comprising:

(a) connecting an electrical line to the completion equipment;

(b) lowering the completion equipment into the well and deploying the electrical line while the completion equipment is in a non operational state;

(c) while the completion equipment is moving downward in the well and without causing the completion equipment to enter an operational state, at least periodically supplying test voltage to the electrical line and displaying a response to the application of test voltage at the surface to monitor the integrity of the completion equipment and the electrical line by measuring a resistance to ground of the electrical line; then (d) when at a desired depth, securing the completion equipment in the well and placing the completion equipment in an operational state;

wherein step (b) comprises unwinding the electrical line from a reel;

mounting a battery-powered test unit to the reel for rotation therewith and connecting a lead of the unit to the electrical line; and wherein step (c) comprises applying test voltage from and receiving the response with the unit.

2. The method according to claim 1, wherein step (c) further comprises transmitting the response from the unit to a monitor by a wireless signal.

3. The method according to claim 1, wherein the completion equipment comprises an electrical submersible pump assembly, and step (d) comprises applying test voltage over the electrical line to the pump assembly.

4. The method according to claim 3, wherein the electrical pump assembly further comprises a pressure sensor, and step (c) comprises applying test voltage to the pressure sensor.

5. The method according to claim 1, wherein the completion equipment comprises an electrical submersible pump assembly, and step (c) comprises measuring an impedance of a motor of the pump assembly.

6. The method according to claim 1, wherein the completion equipment comprises an electrical pump assembly with a three phase motor, and the electrical line has three conductors, and step (c) comprises measuring the impedance between each of the conductors with an AC voltage.

7. A method of installing downhole completion equipment in a well, comprising:

(a) providing the completion equipment with at least one sensor that measures at least one parameter in the environment of the completion equipment;

(b) electrically connecting one end of an electrical line to the sensor;

(c) lowering the completion equipment into the well and deploying the electrical line while the completion equipment is in a non operational state;

(d) while lowering the completion equipment, at least periodically applying test voltage via the electrical line to the sensor without the sensor measuring any parameter in the environment and displaying at the surface an indication that the sensor is operational; then (e) when at a desired depth, securing the completion equipment in the well and placing the completion equipment in an operational state.

8. The method according to claim 7, wherein step (c) comprises unwinding the electrical line from a reel.

9. The method according to claim 8, wherein the method further comprises:

mounting a battery-powered test unit to the reel for rotation therewith and connecting a lead of the unit to the electrical line; and wherein step (d) comprises applying test voltage from and receiving a response from the sensor with the unit.

10. The method according to claim 9, wherein step (d) further comprises transmitting an indication that the sensor is operational from the unit to a monitor by a wireless transmission.

11. The method according to claim 7, wherein the completion equipment comprises an electrical submersible pump assembly, and step (d) comprises applying test voltage over the electrical line to the pump assembly.

12. The method according to claim 11, wherein the completion equipment further comprises a pressure sensor mounted to the pump assembly, and step (d) comprises applying test voltage to the pressure sensor.

13. A method of installing a submersible electrical pump assembly in a well, comprising:

(a) providing the pump assembly with at least one sensor that measures at least one parameter in the environment of the pump assembly;

(b) providing a reel with a quantity of electrical power cable and connecting one end of the power cable to a motor of the pump assembly;

(c) mounting a battery-powered test unit to the reel for rotation therewith, and connecting a lead of the unit to an opposite end of the power cable;

(d) lowering the pump assembly and deploying the power cable from the reel into the well;

(e) while lowering the pump assembly, at least periodically applying test voltage from the unit via the power cable through the motor to the sensor and receiving a response from the sensor at the unit; then (f) transmitting from the unit to a monitor that the response was received.

14. The method according to claim 13, wherein step (f) is performed by a wireless transmission.

15. The method according to claim 13, wherein the sensor comprises a pressure sensor, and the response of step (e) comprises an indication of pressure in the well at the pump assembly.

16. The method according to claim 13, wherein step (e) is performed continuously and simultaneously with step (d).

17. The method according to claim 13, wherein step (e) is performed at selected intervals as the pump assembly is lowered into the well in step (d).

* * * * *